US006589892B1

(12) United States Patent
Smith et al.

(10) Patent No.: US 6,589,892 B1
(45) Date of Patent: Jul. 8, 2003

(54) BICOMPONENT NONWOVEN WEBS CONTAINING ADHESIVE AND A THIRD COMPONENT

(75) Inventors: Kevin Edward Smith, Roswell, GA (US); Bryan David Haynes, Cumming, GA (US); Justin Max Duellman, Little Rock, AK (US); Ann Louise McCormack, Cumming, GA (US); Jeffrey Lawrence McManus, Canton, GA (US); Charles Allen Smith, Snellville, GA (US); Debra Jean McDowall, Roswell, GA (US); Samuel Edward Marmon, Alpharetta, GA (US); Christopher Cosgrove Creagan, Marietta, GA (US); Xin Ning, Alpharetta, GA (US); David Lewis Myers, Cumming, GA (US); Darryl Franklin Clark, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/203,903

(22) Filed: Nov. 13, 1998

(51) Int. Cl.[7] ..... D04H 1/00; D04H 13/00; D04H 1/56; B32B 5/16

(52) U.S. Cl. ..... 442/414; 442/361; 442/362; 442/400; 442/401; 442/417

(58) Field of Search ..... 442/334, 361, 442/362, 35, 400, 401, 414, 417; 604/368; 428/221

(56) References Cited

U.S. PATENT DOCUMENTS

| | | | | | |
|---|---|---|---|---|---|
| 3,338,992 | A | | 8/1967 | Kinney | 264/24 |
| 3,341,394 | A | | 9/1967 | Kinney | 161/72 |
| 3,485,706 | A | | 12/1969 | Evans | 161/72 |
| 3,502,538 | A | | 3/1970 | Petersen | 161/150 |
| 3,502,763 | A | | 3/1970 | Hartmann | 264/210 |
| 3,542,615 | A | | 11/1970 | Dobo et al. | 156/181 |
| 3,692,618 | A | | 9/1972 | Dorschner et al. | 161/72 |
| 3,802,817 | A | | 4/1974 | Matsuki et al. | 425/66 |
| 3,849,241 | A | | 11/1974 | Butin et al. | 161/169 |
| 3,855,046 | A | | 12/1974 | Hansen et al. | 161/150 |
| 3,901,236 | A | | 8/1975 | Assarsson et al. | 128/284 |
| 3,966,865 | A | | 6/1976 | Nishida et al. | 264/147 |
| 4,070,287 | A | * | 1/1978 | Weigand et al. | 210/40 |
| 4,076,663 | A | | 2/1978 | Masuda et al. | 260/17.4 GC |
| 4,100,324 | A | | 7/1978 | Anderson et al. | 428/288 |
| 4,286,082 | A | | 8/1981 | Tsubakimoto et al. | 526/240 |
| 4,340,563 | A | | 7/1982 | Appel et al. | 264/518 |
| 4,369,156 | A | | 1/1983 | Mathes et al. | 264/147 |
| 4,530,353 | A | | 7/1985 | Lauritzen | 128/156 |
| 4,547,420 | A | | 10/1985 | Krueger et al. | 428/229 |
| 4,588,630 | A | | 5/1986 | Shimalla | 428/131 |
| 4,663,220 | A | * | 5/1987 | Wisneski et al. | 428/221 |
| 4,729,371 | A | | 3/1988 | Krueger et al. | 128/206.19 |
| 4,769,279 | A | * | 9/1988 | Graham | 428/296 |
| 4,795,668 | A | | 1/1989 | Krueger et al. | 428/174 |
| 4,818,464 | A | | 4/1989 | Lau | 264/510 |
| 4,879,170 | A | * | 11/1989 | Radwanski et al. | 428/233 |
| 4,902,559 | A | | 2/1990 | Eschwey et al. | |
| 4,923,914 | A | | 5/1990 | Nohr et al. | 524/99 |
| 5,057,166 | A | | 10/1991 | Young, Sr. et al. | 156/62.2 |
| 5,064,689 | A | | 11/1991 | Young, Sr. et al. | 427/202 |
| 5,108,820 | A | | 4/1992 | Kaneko et al. | 428/198 |
| 5,126,201 | A | * | 6/1992 | Shiba et al. | 428/389 |
| 5,147,343 | A | * | 9/1992 | Kellenberger | 604/368 |
| 5,225,014 | A | | 7/1993 | Ogata et al. | 156/73.2 |
| 5,230,959 | A | | 7/1993 | Young, Sr. et al. | 428/372 |
| 5,290,626 | A | | 3/1994 | Nishio et al. | 428/224 |
| 5,302,447 | A | | 4/1994 | Ogata et al. | 428/288 |
| 5,336,552 | A | | 8/1994 | Strack et al. | 428/224 |
| 5,372,885 | A | | 12/1994 | Tabor et al. | 428/373 |
| 5,382,400 | A | | 1/1995 | Pike et al. | 264/168 |
| 5,424,115 | A | | 6/1995 | Stokes | 428/198 |
| 5,432,000 | A | | 7/1995 | Young, Sr. et al. | 428/372 |
| 5,511,960 | A | | 4/1996 | Terakawa et al. | 425/7 |
| 5,516,585 | A | | 5/1996 | Young, Sr. et al. | 428/372 |
| 5,556,589 | A | * | 9/1996 | Sibal | 264/172.12 |
| 5,670,044 | A | | 9/1997 | Ogata et al. | 210/497.01 |
| 5,679,042 | A | | 10/1997 | Varona | 442/347 |
| 5,681,305 | A | | 10/1997 | Korpman | 604/390 |
| 5,685,757 | A | * | 11/1997 | Kirsch et al. | 442/344 |
| 5,695,376 | A | * | 12/1997 | Datta et al. | 442/334 |
| 5,733,822 | A | * | 3/1998 | Gessner et al. | 442/35 |
| 5,759,926 | A | | 6/1998 | Pike et al. | 442/333 |
| 5,866,488 | A | * | 2/1999 | Terada et al. | 442/362 |
| 5,958,806 | A | * | 9/1999 | Jensen et al. | 442/401 |
| 6,007,914 | A | * | 12/1999 | Joseph et al. | 428/391 |
| 6,156,842 | A | * | 12/2000 | Hoenig et al. | 525/171 |
| 6,190,768 | B1 | * | 2/2001 | Turley et al. | 428/364 |

FOREIGN PATENT DOCUMENTS

| | | | |
|---|---|---|---|
| EP | 0 216 520 | 4/1987 | D04H/3/10 |
| EP | 0 534 863 | 3/1993 | D04H/1/54 |
| EP | 0 622 101 | 11/1994 | B01D/39/16 |
| GB | 2 282 155 | 3/1995 | A61L/15/00 |
| JP | XP-002134323 | 7/1981 | |
| JP | XP-002134321 | 2/1992 | |
| JP | 4065568 | 3/1992 | |
| JP | XP-002134325 | 2/1993 | |

(List continued on next page.)

*Primary Examiner*—Cheryl A. Juska
*Assistant Examiner*—Christopher C. Pratt
(74) *Attorney, Agent, or Firm*—Pauley Petersen Kinne & Erickson

(57) ABSTRACT

An improved nonwoven web composite is formed by combining bicomponent thermoplastic filaments having adhesive properties with a component selected from other fibers and particles. The bicomponent filaments include distinct regions of first and second incompatible polymers across a cross-section of individual filaments. After the bicomponent filaments are combined with the other fibers and/or particles, the adhesive properties of the bicomponent filaments result in a web or matrix of filaments having improved ability to entrap, ensnare and contain the other fibers and/or particles within the web or matrix. The nonwoven web composite is particularly useful for making absorbent articles, which require stability and optimum levels of absorbent fibers and/or particles.

35 Claims, No Drawings

FOREIGN PATENT DOCUMENTS

| | | | |
|---|---|---|---|
| JP | XP-002134324 | 1/1995 | |
| JP | 7138866 | 5/1995 | |
| JP | XP-002134322 | 4/1998 | |
| WO | 90/10672 | 9/1990 | ..... C08L/23/12 |
| WO | 90/14414 | 10/1991 | ..... A61F/13/15 |
| WO | 98/03710 | 1/1998 | |
| WO | 98/22643 | 5/1998 | ..... D01F/8/06 |
| WO | 98/45519 | 10/1998 | ..... D04H/1/54 |

* cited by examiner

BICOMPONENT NONWOVEN WEBS CONTAINING ADHESIVE AND A THIRD COMPONENT

FIELD OF THE INVENTION

This invention relates to nonwoven web composites of improved cohecency which exhibit a combination of excellent durability, absorbency, and/or other desirable properties. More specifically, the invention is directed to nonwoven web composites containing a bicomponent filament matrix having adhesive properties, and a third component selected from fibers and particles contained within the matrix.

BACKGROUND OF THE INVENTION

Bicomponent nonwoven filaments are known in the art generally as thermoplastic filaments which employ at least two different polymers combined together in a heterogeneous fashion. Instead of being homogeneously blended, two polymers may, for instance, be combined in a side-by-side configuration, so that a first side of a filament is composed of a first polymer "A" and a second side of the filament is composed of a second polymer "B." Alternatively, the polymers may be combined in a sheath-core configuration, so that an outer sheath layer of a filament is composed of a first polymer "A," and the inner core is composed of a second polymer "B." Alternatively, the polymers may be combined in an islands-in-the-sea configuration in which one or more islands of a first polymer "A" appear in a sea of a second polymer "B." Other heterogeneous configurations are also possible.

Bicomponent filaments offer a combination of desired properties. For instance, certain polypropylene resins yield filaments which are strong but not particularly soft. Certain polyethylene resins yield filaments which are soft but not particularly strong. By combining both resins together in the form of bicomponent nonwoven filaments, a hybrid combination of strength and softness can be achieved.

Bicomponent filaments have been disclosed in combination with carbon particles, zeolites, ion exchange resins, carbon filters, sterilizing fibers, and/or gas adsorbing fibers for use in specialized filters. U.S. Pat. No. 5,670,044, issued to Ogata et al., discloses the use of bicomponent meltblown filaments in these combinations, for use in cylindrical filters. In that case, the bicomponent filaments contain high and low melting polymers. The filaments of the filter are stacked and bonded together by melting only the lower melting component.

Pulp fibers have been employed in certain absorbent applications to enhance the absorbency. U.S. Pat. No. 4,530,353, issued to Lauritzen, discloses pulp fibers in combination with staple length bicomponent fibers used in the manufacture of absorbent bandages. In that case, the fibers also contain high and low melting polymers. The staple length fibers are bonded together by melting only the lower melting component.

In applications where a third component selected from fibers and/or particles is combined with a bicomponent filament web, the bicomponent filaments act as a matrix which ensnares, entraps, and contains the third component. In some of these applications (for instance, absorbent applications where the third component is an absorbent), there is a need or desire to increase the amount of the third component in order to maximize the properties that it contributes to the nonwoven web composite. There is also a need or desire to improve the containment properties of the bicomponent filament matrix at all levels of third component loading.

SUMMARY OF THE INVENTION

The present invention is directed to an improved nonwoven web composite including a matrix of bicomponent thermoplastic filaments and a third component selected from fibers, particles, and combinations thereof contained within the filaments. The nonwoven web composite exhibits improved containment of the third component, permitting higher loading of the third component as well as improved durability at all loading levels. The present invention is also directed to an absorbent article, including a personal care absorbent article, which utilizes the improved nonwoven web composite of the invention.

The bicomponent thermoplastic filaments contain at least first and second thermoplastic polymer components, arranged in distinct segments or zones across the width of the filament. At least one of the thermoplastic polymers possesses adhesive properties with respect to the third component, or is modified to possess adhesive properties with respect to the third component. The adhesive properties may be imparted by either a) employing an adhesive polymer for at least one of the distinct thermoplastic polymer segments in the bicomponent filaments, which segment is exposed at the filament surface, b) modifying a non-adhesive polymer by blending it with an adhesive polymer and employing the blend for one of the distinct polymer segments in the bicomponent filaments, which segment is exposed at the filament surface, or c) surface-modifying the bicomponent filaments or a segment thereof by spraying, dipping, or otherwise applying an adhesive material effective to bond the bicomponent filaments to the third component.

With the foregoing in mind, it is a feature and advantage of the invention to provide a nonwoven web composite containing a filament matrix and a loaded component (fibers and/or particles) within the matrix, having improved durability and stability due to adhesion between the filament matrix and loaded component.

It is also a feature and advantage of the invention to provide an absorbent nonwoven web composite capable of containing high loadings of absorbent fibers and/or particles, due to adhesion between the absorbent material and the nonwoven thermoplastic filament matrix which contains it.

It is also a feature and advantage of the invention to provide an absorbent article having improved absorption and durability, due to better continence of absorbent fibers and/or particles within a nonwoven filament matrix, and a higher loading capacity for the absorbent fibers and/or particles.

DEFINITIONS

The term "nonwoven fabric or web" means a web having a structure of individual fibers or threads which are interlaid, but not in a regular or identifiable manner as in a knitted fabric. Nonwoven fabrics or webs have been formed from many processes such as, for example, meltblowing processes, spunbonding processes, air laying processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91.)

The term "microfibers" means small diameter fibers having an average diameter not greater than about 75 microns, for example, having an average diameter of from about 1 micron to about 50 microns, or more particularly, having an average diameter of from about 1 micron to about 30 microns. Another frequently used expression of fiber diameter is denier, which is defined as grams per 9000 meters of a fiber. For a fiber having circular cross-section, denier may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex," which is defined as the grams per kilometer of fiber. Tex may be calculated as denier/9.

The term "spunbonded fibers" refers to small diameter fibers which are formed by extruding molten thermoplastic material as filaments from a plurality of fine capillaries of a spinnerette having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al., each of which is incorporated herein in its entirety by reference. Spunbond fibers are quenched and deposited onto a collecting surface. Spunbond fibers are generally continuous and often have average diameters larger than about 7 microns, more particularly, between about 10 and 30 microns.

The term "meltblown fibers" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin. Meltblown fibers are microfibers which may be continuous or discontinuous, are generally smaller than 10 microns in diameter, and are generally self bonding when deposited onto a collecting surface. Meltblown fibers used in the present invention are preferably substantially continuous in length.

The term "substantially continuous filaments of fibers" refers to filaments or fibers prepared by extrusion from a spinnerette, including without limitation spunbonded and meltblown fibers, which are not cut from their original length prior to being formed into a nonwoven web or fabric. Substantially continuous filaments or fibers may have average lengths ranging from greater than about 15 cm to more than one meter, and up to the length of the nonwoven web or fabric being formed. The definition of "substantially continuous filaments or fibers" includes those which are not cut prior to being formed into a nonwoven web or fabric, but which are later cut when the nonwoven web or fabric is cut.

The term "staple fibers" means fibers which are natural or cut from a manufactured filament prior to forming into a web, and which have an average length ranging from about 0.1–15 cm, more commonly about 0.2–7 cm.

The term "pulp fibers" refers to fibers from natural sources such as woody and non-woody plants. Woody plants include, for example, deciduous and coniferous trees. Non-woody plants include, for instance, cotton, flax, esparto grass, milkweed, straw, jute hemp, and bagasse.

The term "average pulp fiber length" refers to a weighted average length of pulp determined using a Kajaani fiber analyzer Model No. FS-100 available from Kajaani Oy Electronics in Kajaani, Finland. Under the test procedure, a fiber sample is treated with a macerating liquid to ensure that no fiber bundles or shives are present. Each fiber sample is dispersed in hot water and diluted to about a 0.001% concentration. Individual test samples are drawn in approximately 50 to 500 ml portions from the dilute solution and tested using the standard Kajaani fiber analysis procedure. The weighted average fiber lengths may be expressed by the following equation:

$$\sum_{X_i>0}^{k} (X_i * n_i)/n$$

where k=maximum fiber length, $X_i$=individual fiber length, $n_i$=number of fibers having length $X_i$ and n=total number of fibers measured.

The term "superabsorbent material" refers to a water-swellable, water-insoluble organic or inorganic material capable, under the most favorable conditions, of absorbing at least 20 times its weight, preferably at least about 30 times its weight in an aqueous solution containing 0.9% by weight sodium chloride.

The term "polymer" generally includes without limitation homopolymers, copolymers (including, for example, block, graft, random and alternating copolymers), terpolymers, etc., and blends and modifications thereof. Furthermore, unless otherwise specifically limited, the term "polymer" shall include all possible geometrical configurations of the material. These configurations include, but are not limited to isotactic, syndiotactic and atactic symmetries.

The term "bicomponent filaments or fibers" refers to fibers which have been formed from at least two polymers extruded from separate extruders but spun together to form one fiber. The polymers are arranged in substantially constantly positioned distinct zones across the cross-section of the bicomponent fibers and extend continuously along the length of the bicomponent fibers. The configuration of such a bicomponent fiber may be, for example, a sheath/core arrangement wherein one polymer is surrounded by another, or may be a side-by-side arrangement or an "islands-in-the-sea" arrangement. Bicomponent fibers are taught in U.S. Pat. No. 5,108,820 to Kaneko et al., U.S. Pat. No. 5,336,552 to Strack et al., and U.S. Pat. No. 5,382,400 to Pike et al., each of which is incorporated herein in its entirety by reference. For two component fibers, the polymers may be present in ratios of 75/25, 50/50, 25/75 or any other desired ratios. Conventional additives, such as pigments and surfactants, may be incorporated into one or more polymer streams, or applied to the filament surfaces.

The terms "adhesive polymer," "adhesive polymer blend" and "adhesive filament" refer to any polymer, polymer blend or filament containing them which exhibit a sticking force to a third component fiber or particle, no matter how small. This includes any kind of adhesion or tack. If a fiber or particle exhibits a binding force to, or reluctance to separate from, a thermoplastic polymer filament when the filament is positioned adjacent the fiber or particle and the fiber or particle is subject to a gravitational or other pulling or sliding force, then at least one polymer in the filament exhibits a sticking (i.e., adhesive) force to the fiber or particle.

The terms "adhesive-modified polymer," "adhesive modified polymer blend" and "adhesive-modified filament" refer to a polymer, polymer blend, or filament containing them which has been modified (through surface coating, blending, or otherwise) so that it exhibits an adhesive force to a fiber or particle, as defined above.

The term "bicomponent filaments having adhesive properties" refers to any adhesive bicomponent filament as well as to any adhesive-modified bicomponent filament.

The term "personal care absorbent article" includes diapers, training pants, swim wear, absorbent underpants, baby wipes, adult incontinence products and feminine hygiene products.

The term "through-air bonding" or "TAB" means a process of bonding a nonwoven, for example, a bicomponent fiber web in which air which is sufficiently hot to melt one of the polymers of which the fibers of the web are made is forced through the web. The air velocity is often between 100 and 500 feet per minute and the dwell time may be as long as 6 seconds. The melting and resolidification of the polymer provides the bonding. Through-air bonding has restricted variability and is generally regarded as a second step bonding process. Since TAB requires the melting of at least one component to accomplish bonding, it is restricted to webs with two components such as bicomponent fiber webs or webs containing an adhesive fiber or powder.

The term "thermal point bonding" involves passing a fabric or web of fibers to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g., like a window screen. Typically, the percent bonding area varies from around 10% to around 30% of the area of the fabric laminate web. As is well known in the art, the spot bonding holds the laminate layers together as well as imparts integrity to each individual layer by bonding filaments and/or fibers within each layer.

DETAILED DESCRIPTION OF THE PRESENTLY PREFERRED EMBODIMENTS

The present invention is directed to a nonwoven web composite including a matrix of bicomponent thermoplastic polymer filaments having adhesive properties, namely, including adhesive filaments and/or adhesive-modified filaments. The matrix may optionally contain non-adhesive thermoplastic filaments (bicomponent or single-component) with the adhesive filaments. A third component, selected from fibers, particles and combinations thereof, is contained within the filaments. The nonwoven web composite contains from about 5–97% by weight of the third component (fibers, particles, or combinations thereof) and about 3–95% by weight of the adhesive and/or adhesive-modified bicomponent thermoplastic filaments. Preferably, the nonwoven web composite contains about 35–95% by weight of the third component and about 5–65% by weight of the adhesive bicomponent filaments. More preferably, the nonwoven web composite contains about 50–95% by weight of the third component and about 5–50% by weight of the thermoplastic bicomponent filaments having adhesive properties.

The bicomponent thermoplastic filaments having adhesive properties may have any of the bicomponent configurations described above. Preferably, the filaments have either a side-by-side configuration or a sheath-core configuration. In these configurations, the polymers within the filaments extend the length of the filaments. The bicomponent filaments are preferably substantially continuous in length. Substantially continuous filaments provide better containment of the third component and better liquid distribution than staple length fibers. The bicomponent filaments may be spunbond or meltblown, for instance, and may have an average diameter of about 1–75 microns, preferably about 1–50 microns, more preferably about 1–30 microns. Other processes for forming thermoplastic bicomponent filaments may also be employed. The filaments may be crimped, using techniques available to persons skilled in the art.

The bicomponent filaments having adhesive properties contain at least two thermoplastic polymers. In one embodiment, the thermoplastic bicomponent filaments contain a first polymer (or polymer blend) which imparts a first desirable property to the filaments, and a second polymer (or polymer blend) which imparts adhesive properties to the filaments. In another embodiment, the thermoplastic bicomponent filaments contain a first polymer (or polymer blend) which imparts a first desirable property, a second polymer (or polymer blend) which imparts a second desirable property, and an adhesive modifier (e.g., a surface treatment) which imparts adhesive properties to the filaments. Examples of desirable properties attributable to different polymers or blends include without limitation durability, softness, wettability, elasticity, strength, stability, aesthetic appearance, and other desirable properties. Of course, the first polymer may contribute one or more desirable properties, and the second polymer may contribute adhesion and/or one or more additional desirable properties. Also, the bicomponent filaments may include more than two distinct polymers, with each polymer contributing unique properties. Additives, such as pigments and hydrophilic modifiers, may be incorporated into one or both polymers, or applied to the filament surfaces.

Examples of polymer components which contribute durability to bicomponent filament webs include without limitation polypropylene homopolymers, polypropylene copolymers containing up to about 10% ethylene or another $C_4$–$C_{20}$ alpha-olefin comonomer, high density polyethylenes, linear low density polyethylenes in which the alpha-olefin comonomer content is less than about 10% by weight, polyamides, polyesters polycarbonates, polytetrafluoroethylenes, and other high tensile materials. Generally, a first polymer can be said to contribute durability to bicomponent filaments when a nonwoven web made from bicomponent filaments containing a first polymer and a second polymer withstands a tensile load which is at least about 10% greater, and preferably at least about 30% greater, than a similar nonwoven web made from similar filaments containing the second polymer alone.

Examples of polymer components which contribute flexibility and softness to bicomponent filament webs include without limitation high pressure (branched) low density polyethylenes, linear low density polyethylenes in which the alpha-olefin comonomer content is more than about 10% by weight, copolymers of ethylene with at least one vinyl monomer (for example, ethylene vinyl acetate), copolymers of ethylene with unsaturated aliphatic carboxylic acids (including ester derivatives thereof) and copolymers of any two alpha-olefins having 2–20 carbon atoms wherein the content of each of the two comonomers exceeds 10% by weight of the copolymer (including, for instance, ethylene-propylene rubbers). Also included are polyurethanes, and A-B and A-B-A' block copolymers where A and A' are thermoplastic end blocks and B is an elastomeric block. Generally, a second polymer can be said to contribute flexibility and/or softness to a bicomponent nonwoven web when a nonwoven web made from filaments containing a first polymer and the second polymer is more flexible, and/or has a softer feel, than a similar nonwoven web made from similar filaments containing the first polymer alone.

Examples of polymers which contribute wettability to a thermoplastic nonwoven web include without limitation polyamides, polyvinyl acetates, saponified polyvinyl acetates, saponified ethylene vinyl acetates, and other hydrophilic materials. A second polymer generally contributes to the wettability of bicomponent filaments if a droplet of water positioned on a nonwoven web made from bicomponent filaments containing first and second polymers has a contact angle which is a) less than 90° measured using ASTM D724–89, and b) less than the contact angle of a similar nonwoven web made from similar filaments containing only the first polymer.

Examples of polymers which contribute elastic properties to a thermoplastic nonwoven web include without limitation styrene-butadiene copolymers; elastomeric (single-site, e.g., metallocene-catalyzed) polypropylene, polyethylene, and other metallocene-catalyzed alpha-olefin homopolymers and copolymers having density less than about 0.89 grams/cc; other amorphous poly alpha-olefins having density less than about 0.89 grams/cc; ethylene vinyl acetate copolymers; ethylene propylene rubbers; and propylene-butene-1 copolymers and terpolymers. Elastomeric polymers may help to facilitate crimping of the bicomponent filaments, as discussed later in the specification.

Examples of polymers which contribute adhesion to the bicomponent filaments (i.e., adhesive polymers) may vary depending on the third component substrate to which adhesion is desired. Polymers which adhere to one third component substrate may not adhere to another. Examples of adhesive polymers effective for a variety of substrates include without limitation polyolefin waxes, for example polyethylene waxes and polypropylene waxes; amorphous polyethylenes and polypropylenes; ethylene propylene and butene propylene copolymers containing more than 10% of each comonomer; terpolymers of ethylene, propylene and butene; styrene-butadiene block copolymers, tackifiers and rubbers; ethylene vinyl acetate copolymers containing more than 5% by weight vinyl acetate; ethylene alkyl acrylates, including ethylene methyl acrylate, ethylene ethyl acrylate and ethylene-n-butyl acrylate; poly (4-methyl-1-pentene); various alpha-olefin polymers and copolymers in which at least one alpha-olefin comonomer has 4–20 carbon atoms; hydrocarbon resins and tackifiers; formulated hot melt adhesives; combinations including the foregoing; and various other materials.

Of course, the ability of polymers to contribute adhesion and other desirable properties to nonwoven bicomponent filaments requires that there be a sufficient amount of each polymer in the filaments. Generally, the bicomponent thermoplastic filaments contain about 10–90% by weight of the first selected polymer and about 10–90% by weight of the second selected polymer. The bicomponent filaments will preferably include about 25–75% by weight of each polymer, more preferably about 40–60% by weight of each polymer.

The adhesive properties may alternatively be imparted to the bicomponent filaments by initially forming the bicomponent filaments using non-adhesive polymers, and then surface coating the filaments with an adhesive polymer. For instance, an adhesive polymer may be dissolved in solution and applied by spray coating, brushing, dipping, printing, or other solution techniques. Alternatively, an adhesive polymer may be applied by hot melt techniques, for example melt blowing, melt spraying or melt printing. The resulting adhesive-modified bicomponent filaments may then be combined with the third component. Alternatively, the adhesive coating may occur after the bicomponent filaments are combined with a third component.

A wide variety of third component fibers and/or particles may be incorporated into the matrix of bicomponent filaments having adhesive properties, to make the nonwoven web composite of the invention having improved durability and containment properties. Fibers which can be employed as the third component include, without limitation, absorbent fibers such as rayon staple fibers, cotton fibers, short length natural cellulose fibers such as wood pulp fibers and cotton linters, other pulp fibers, superabsorbents that are in fiber form, and combinations of the foregoing.

Other useful fibers include fiberized feathers; for example, fiberized poultry feathers such as fiberized chicken feathers. Particles can be employed as the third component alone or in combination with fibers. Examples of useful particulate materials include, without limitation, activated charcoal, clays, starches, superabsorbents in particle form, and odor absorbents such as zeolites, yucca chitosan and molecular sieve materials.

The thermoplastic bicomponent nonwoven filaments may be combined with the third component materials using processes well known in the art. For example, a coform process may be employed, in which at least one meltblown diehead is arranged near a chute through which other materials are added while the web is forming. Coform processes are described in U.S. Pat. Nos. 4,818,464 to Lau and 4,100,324 to Anderson et al., the disclosures of which are incorporated by reference. The thermoplastic bicomponent filaments and third component materials may also be combined using hydraulic entangling or mechanical entangling. A hydraulic entangling process is described in U.S. Pat. No. 3,485,706 to Evans, the disclosure of which is incorporated by reference.

Pulp fibers are especially useful as the third component when the composite nonwoven web is employed as an absorbent article. Preferred pulp fibers include cellulose pulp fibers. The pulp fibers may be any high average fiber length pulp, low average fiber length pulp, or mixture thereof.

The term "high average fiber length pulp" refers to pulp that contains a relatively small amount of short fibers and non-fiber particles. High fiber length pulps typically have an average fiber length greater than about 1.5 mm, preferably about 1.5–6 mm, as determined by an optical fiber analyzer, such as the Kajaani tester referenced above. Sources generally include non-secondary (virgin) fibers as well as secondary fiber pulp which has been screened. Examples of high average fiber length pulps include bleached and unbleached virgin softwood fiber pulps.

The term "low average fiber length pulp" refers to pulp that contains a significant amount of short fibers and non-fiber particles. Low average fiber length pulps have an average fiber length less than about 1.5 mm, preferably about 0.7–1.2 mm, as determined by an optical fiber analyzer such as the Kajaani tester referenced above. Examples of low fiber length pulps include virgin hardwood pulp, as well as secondary fiber pulp from sources such as office waste, newsprint, and paperboard scrap.

Examples of high average fiber length wood pulps include those available from the U.S. Alliance Coosa Pines Corporation under the trade designations Longlac 19, Coosa River 56, and Coosa River 57. The low average fiber length pulps may include certain virgin hardwood pulp and secondary (i.e., recycled) fiber pulp from sources including newsprint, reclaimed paperboard, and office waste. Mixtures of high average fiber length and low average fiber length pulps may contain a predominance of low average fiber length pulps. For example, mixtures may contain more than about 50% by weight low-average fiber length pulp and less than about 50% by weight high-average fiber length pulp. One exemplary mixture contains about 75% by weight low-average fiber length pulp and about 25% by weight high-average fiber length pulp.

The pulp fibers may be unrefined or may be beaten to various degrees of refinement. Crosslinking agents and/or hydrating agents may also be added to the pulp mixture. Debonding agents may be added to reduce the degree of hydrogen bonding if a very open or loose nonwoven pulp fiber web is desired. One exemplary debonding agent is available from the Quaker Oats Chemical Company, Conshohocken, Pennsylvania, under the trade designation Quaker 2008. The addition of certain debonding agents in the amount of, for example, 1–4% by weight of the composite, may reduce the measured static and dynamic coefficients of friction and improve the abrasion resistance of the thermoplastic continuous polymer filaments. The debonding agents act as lubricants or friction reducers. Debonded pulp fibers are commercially available from Weyerhaeuser Corp. under the designation NB405.

In one highly advantageous embodiment, the third component includes a combination of pulp fibers and superabsorbent particles and/or fibers, resulting in formation of a highly absorbent nonwoven web composite. The term "superabsorbent" or "superabsorbent material" refers to a water-swellable, water-insoluble organic or inorganic material capable, under the most favorable conditions, of absorbing at least about 20 times its weight and, more desirably, at least about 30 times its weight in an aqueous solution containing 0.9 weight percent sodium chloride.

The superabsorbent materials can be natural, synthetic and modified natural polymers and materials. In addition, the superabsorbent materials can be inorganic materials, such as silica gels, or organic compounds such as cross-linked polymers. The term "cross-linked" refers to any means for effectively rendering normally water-soluble materials substantially water insoluble but swellable. Such means can include, for example, physical entanglement, crystalline domains, covalent bonds, ionic complexes and associations, hydrophilic associations, such as hydrogen bonding, and hydrophobic associations or Van der Waals forces.

Examples of synthetic superabsorbent material polymers include the alkali metal and ammonium salts or poly(acrylic acid) and poly(methacrylic acid), poly(acrylamides), poly (vinyl ethers), maleic anhydride copolymers with vinyl ethers and alpha-olefins, poly(vinyl pyrrolidone), poly (vinylmorpholinone), poly(vinyl alcohol), and mixtures and copolymers thereof. Further superabsorbent materials include natural and modified natural polymers, such as hydrolyzed acrylonitrile-grafted starch, acrylic acid grafted starch, methyl cellulose, chitosan, carboxymethyl cellulose, hydroxypropyl cellulose, and the natural gums, such as alginates, xanthan gum, locust bean gum and the like. Mixtures of natural and wholly or partially synthetic superabsorbent polymers can also be useful in the present invention. Other suitable absorbent gelling materials are disclosed by Assarsson et al. in U.S. Pat. No. 3,901,236, issued Aug. 26, 1975. Processes for preparing synthetic absorbent gelling polymers are disclosed in U.S. Pat. No. 4,076,663, issued Feb. 28, 1978, to Masuda et al. and U.S. Pat. No. 4,286,082, issued Aug. 25, 1981, to Tsubakimoto et al.

Superabsorbent materials may be xerogels which form hydrogels when wetted. The term "hydrogel," however, has commonly been used to also refer to both the wetted and unwetted forms of the superabsorbent polymer material. The superabsorbent materials can be in many forms such as flakes, powders, particulates, fibers, continuous fibers, networks, solution spun filaments and webs. Particles can be of any desired shape, for example, spiral or semi-spiral, cubic, rod-like, polyhedral, etc. Needles, flakes, fibers, and combinations may also be used.

When used, the superabsorbent material may be present within the absorbent nonwoven web composite in an amount from about 5 to about 90 weight percent based on total weight of the absorbent nonwoven composite. Preferably, the superabsorbent constitutes about 10–60% by weight of the absorbent nonwoven web composite, more preferably about 20–50% by weight. Superabsorbents are generally available in particle sizes ranging from about 20 to about 1000 microns. Examples of commercially available particulate superabsorbents include SANWET® IM 3900 and SANWET® IM-5000P, available from Hoescht Celanese located in Portsmouth, Va., DRYTECH® 2035LD available from Dow Chemical Co. located in Midland, Mich., and FAVOR® 880 available from Stockhausen, located in Sweden. An example of a fibrous superabsorbent is OASIS®101, available from Technical Absorbents, located in Grimsby, United Kingdom.

The superabsorbents may be added using the same techniques described above for combining the pulp fibers and bicomponent nonwoven filaments. For instance, the superabsorbent can be added with the pulp into the forming stream for the bicomponent filaments as they are being extruded onto a conveyor to form a nonwoven web, or at a later point in the forming stream, separate from the pulp. Alternatively, the superabsorbent can be added to a nonwoven web using a hydraulic entangling process.

After combining the ingredients, the absorbent nonwoven web composite may be bonded together using the through-air bonding or thermal point bonding techniques described above, to provide a coherent high integrity structure. Various improvements and alternative embodiments are also considered to be within the scope of the invention. In one embodiment, the bicomponent thermoplastic filaments having adhesive properties, are combined with other thermoplastic filaments in addition to pulp fibers. For instance, the bicomponent thermoplastic filaments having adhesive properties may include a mixture of bicomponent spunbond filaments and bicomponent meltblown filaments. In this embodiment, the spunbond filaments impart greater strength and the meltblown filaments are more effective in capturing and entangling the third component fibers and/or particles. Also, the bicomponent filaments having adhesive properties may be combined with nonadhesive filaments (bicomponent or single component).

In still another embodiment, the bicomponent filaments having adhesive properties may be spunbond and mixed with meltblown fibers (not necessarily bicomponent) which have a relatively low melting point. The composite web may thus be formed by combining three or more streams of bicomponent spunbond filaments, lower melting meltblown filaments and pulp fibers. The meltblown filaments may still be hot and tacky when the third component particles and/or fibers are introduced, and may fuse with the third component to help consolidate the structure. Meltblown microfibers, which typically have diameters much smaller than spunbond fibers, may in effect serve as an additional binder or adhesive for the third component fibers and/or particles.

In another embodiment, an elastic polymer may be combined with an inelastic polymer in side-by-side bicomponent filaments to produce bicomponent filaments having a tendency to crimp. The elastic polymer may also be an adhesive polymer. The resulting crimped bicomponent filaments having adhesive properties, are preferably in the form of meltblown microfibers, which are relatively fine and flexible. Crimped bicomponent filaments having adhesive properties can be used with or without other thermoplastic filaments in a nonwoven web to provide enhanced bulk and lower web density. In the nonwoven webs of the present invention, the crimped bicomponent filaments may also be used to help ensnare and entangle the third component particles and/or fibers.

Exemplary combinations of elastic (potentially adhesive) and inelastic materials, useful for producing crimped bicomponent filaments having adhesive properties, include without limitation the following:

| Relatively Elastic Polymers | Relatively Inelastic Polymers |
|---|---|
| Styrene-butadiene copolymer | Polypropylene |
| Styrene-butadiene copolymer | Polyethylene |
| Elastomeric (single-site or metallocene catalyzed) polypropylene | Polypropylene or polyethylene |
| Elastomeric (single-site or metallocene catalyzed) polyethylene | Polyethylene or polypropylene |
| Polyurethane | Polypropylene or polyethylene |
| Ethylene vinyl acetate copolymer | Polypropylene or polyethylene |
| Ethylene propylene rubber | Polypropylene or polyethlene |

Notes:
1. Unless otherwise indicated, polymers are not made using a metallocene catalyst.
2. Unless otherwise indicated, polypropylene polymers are substantially isotactic.

In addition to combinations of elastic and inelastic polymers, other polymer combinations can be employed to achieve crimping. For instance, crimping may be achieved using combinations of heat shrinkable polymers (polymers whose filaments shrink upon secondary heating to a temperature below the melting peak) with non-heat shrinkable polymers in the substantially continuous bicomponent thermoplastic filaments. Since many heat-shrinkable polymers are non-adhesive, the filaments should be modified using techniques described above to impart adhesive properties. Exemplary combinations of heat shrinkable and non-heat shrinkable polymers include without limitation the following:

| Relatively Heat Shrinkable Polymers | Relatively Non-Heat Shrinkable Polymers |
|---|---|
| Polyethylene terephthalate (non-adhesive) | Polyethylene or polypropylene |
| Polybutylene terephthalate (non-adhesive) | Polyethylene or polypropylene |
| Ethylene vinyl acetate copolymer (adhesive) | Polyethylene or polypropylene |

Certain other polymer combinations also result in shrinkage, when extended side-by-side in a substantially continuous thermoplastic bicomponent filament. These combinations include, without limitation, the following:

| First Polymer | Second Polymer |
|---|---|
| Lower viscosity polymer | Higher viscosity polymer |
| Polypropylene | Polyethlene |
| Polypropylene | Atactic polypropylene |
| Polyethylene | Atactic polypropylene |

The improved nonwoven composite material of the invention can be used in a wide variety of absorbent and other products including, without limitation, personal care absorbent articles. Personal care absorbent articles include diapers, training pants, swim wear, absorbent underpants, baby wipes, adult incontinence products, feminine hygiene products, and the like. The improved nonwoven composite is particularly useful in diapers, baby wipes, and other applications requiring durability, and high loading and retention of the third component. In these applications the third component may, for instance, include a combination of pulp fibers and superabsorbent. The nonwoven composite material of the invention may also be used in a wide variety of other absorbent and non-absorbent applications including, without limitation, medical absorbent products such as underpads, bandages, absorbent drapes, and medical wipes containing alcohol and/or other disinfectants.

While the embodiments of the invention described herein are presently considered preferred, various modifications and improvements can be made without departing from the spirit and scope of the invention. The scope of the invention is indicated by the appended claims, and all changes within the meaning and range of equivalents are intended to be embraced therein.

We claim:

1. A nonwoven web composite, comprising:

a matrix of substantially continuous thermoplastic bicomponent filaments having adhesive properties, including a first thermoplastic polymer and a second thermoplastic polymer arranged in distinct zones across a cross-section of individual bicomponent filaments; and an absorbent third component contained within the matrix, the third component selected from the group consisting of absorbent fibers, absorbent particles, and combinations thereof; and the substantially continuous thermoplastic bicomponent filaments being at least one of spunbond or meltblown filaments; and the filament matrix comprising a mixture of spunbond and meltblown filaments.

2. The nonwoven web composite of claim 1, wherein the thermoplastic bicomponent filaments are arranged in a side-by-side configuration.

3. The nonwoven web composite of claim 1, wherein the thermoplastic bicomponent filaments are arranged in a sheath-core configuration.

4. The nonwoven web composite of claim 1, wherein the thermoplastic bicomponent filaments are arranged in an islands-in-the-sea configuration.

5. The nonwoven web composite of claim 1, wherein at least one of the first and second thermoplastic polymers comprises an adhesive polymer and wherein the adhesive polymer comprises a material selected from the group consisting of polystyrene waxes, polypropylene waxes, amorphous polyethylenes, amorphous polypropylenes, ethylene-propylene and butene-propylene copolymers containing more than 10% of each comonomer, terpolymers of ethylene-propylene-butene, styrene-butadiene tackifiers and rubbers, ethylene vinyl acetate copolymers containing more than 5% by weight vinyl acetate, poly(4-methyl-1-pentene), alpha-olefin polymers and copolymers in which at least one alpha-olefin has 4–20 carbon atoms, hydrocarbon resins and tackifiers, and combinations thereof.

6. The nonwoven web composite of claim 1, wherein the thermoplastic bicomponent filaments comprise adhesive-modified filaments.

7. The nonwoven web composite of claim 1, wherein at least one of the first and second polymers comprises a relatively durable polymer and wherein the relatively durable polymer comprises a material selected from the group consisting of polypropylene homopolymers and copolymers containing up to about 10% by weight of an alpha-olefin comonomer, linear low density polyethylene having an alpha-olefin comonomer content less than about 10% by weight, polycarbonates, and combinations thereof.

8. The nonwoven web composite of claim 1, wherein at least one of the first and second polymers comprises a relatively soft polymer.

9. The nonwoven web composite of claim 8, wherein the relatively soft polymer comprises a material selected from the group consisting of branched low density polyethylene, linear low density polyethylene having an alpha-olefin comonomer content of more than about 10% by weight, copolymers of ethylene with at least one vinyl comonomer, copolymers of ethylene with unsaturated aliphatic carboxylic acids and ester derivatives thereof, other copolymers of any two alpha-olefins having up to 20 carbon atoms wherein the content of each of the two comonomers exceeds about 10% by weight of the copolymer, and combinations thereof.

10. The nonwoven web composite of claim 1, wherein at least one of the first and second polymers comprises an elastic polymer and wherein the elastic polymer comprises a material selected from the group consisting of styrene-butadiene copolymers; single-site-catalyzed polypropylene, polyethylene and other alpha-olefin homopolymers and copolymers having density less than about 0.89 grams/cc; other amorphous poly alpha-olefins having density less than about 0.89 grams/cc; ethylene-vinyl acetate copolymers; and combinations thereof.

11. The nonwoven web composite of claim 1, wherein the thermoplastic bicomponent filaments comprise crimped filaments.

12. The nonwoven web composite of claim 11, wherein the first thermoplastic polymer comprises a relatively elastic polymer and the second thermoplastic polymer comprises a relatively inelastic polymer.

13. The nonwoven web composite of claim 11, wherein the first thermoplastic polymer comprises a relatively heat shrinkable polymer and the second thermoplastic polymer comprises a relatively non-heat shrinkable polymer.

14. The nonwoven web composite of claim 1, wherein the thermoplastic bicomponent filaments further comprise a surface treatment, the surface treatment including a polymer selected from the group consisting of polyethylene waxes, polypropylene waxes, amorphous polyethylenes, amorphous polypropylenes, ethylene-propylene and butene-propylene copolymers containing more than 10% of each comonomer, terpolymers of ethylene-propylene-butene, styrene-butadiene tackifiers and rubbers, ethylene vinyl acetate copolymers containing more than 5% by weight vinyl acetate, ethylene alkyl acrylates, poly(4-methyl-1-pentene), alpha-olefin polymers and copolymers in which at least one alpha-olefin has 4–20 carbon atoms, hydrocarbon resins and tackifiers, hot melt adhesives, and combinations thereof.

15. The nonwoven web composite of claim 1, wherein the third component comprises absorbent fibers selected from the group consisting of rayon fibers, cotton fibers, cellulose fibers, pulp fibers, superabsorbent fibers, fiberized feathers, and combinations thereof.

16. The nonwoven web composite of claim 1, wherein the third component comprises particles selected from the group consisting of charcoal, clays, starches, superabsorbent particles, odor absorbents, and combinations thereof.

17. The nonwoven web composite of claim 1, wherein the third component comprises pulp fibers and a superabsorbent.

18. The nonwoven web composite of claim 1, comprising about 3–95% by weight of the thermoplastic bicomponent filaments and about 5–97% by weight of the third component.

19. The nonwoven web composite of claim 1, comprising about 5–65% by weight of the thermoplastic bicomponent filaments and about 35–95% by weight of the third component.

20. The nonwoven web composite of claim 1, comprising about 5–50% by weight of the thermoplastic bicomponent filaments and about 50–95% by weight of the third component.

21. The nonwoven web composite of claim 1, wherein one thermoplastic polymer comprises a polyolefin wax.

22. The nonwoven web composite of claim 1, wherein one thermoplastic polymer comprises a material selected from ethylene-propylene copolymers, butene-propylene copolymers, and ethylene-propylene-butene terpolymers.

23. The nonwoven web composite of claim 1, wherein one thermoplastic polymer comprises a styrene-butadiene polymer.

24. The nonwoven web composite of claim 1, wherein one thermoplastic polymer comprises an ethylene alkyl acrylate copolymer.

25. The nonwoven web composite of claim 1, wherein one thermoplastic polymer comprises ethylene vinyl acetate.

26. The nonwoven web composite of claim 1, wherein one thermoplastic polymer comprises an alpha-olefin copolymer including at least one monomer having 4–20 carbon atoms.

27. The nonwoven web composite of claim 1, wherein one thermoplastic polymer comprises a hydrocarbon.

28. A wipe comprising the nonwoven web composite of claim 1.

29. A diaper comprising the nonwoven web composite of claim 1.

30. Underpants comprising the nonwoven web composite of claim 1.

31. A feminine hygiene product comprising the nonwoven web composite of claim 1.

32. An incontinence product comprising the nonwoven web composite of claim 1.

33. Swim wear comprising the nonwoven web composite of claim 1.

34. Training pants comprising the nonwoven web composite of claim 1.

35. A medical absorbent product comprising the nonwoven web composite of claim 1.

* * * * *